US010026303B1

(12) United States Patent
Skarda

(10) Patent No.: US 10,026,303 B1
(45) Date of Patent: Jul. 17, 2018

(54) SYSTEM AND METHOD FOR CONFIGURING A SECURITY SYSTEM USING NEAR-FIELD COMMUNICATION

(71) Applicant: Nortek Security & Control LLC, Carlsbad, CA (US)

(72) Inventor: Brian Vencil Skarda, South Jordan, UT (US)

(73) Assignee: Nortek Security & Control LLC, Carlsbad, CA (US)

( * ) Notice: Subject to any disclaimer, the term of this patent is extended or adjusted under 35 U.S.C. 154(b) by 0 days.

(21) Appl. No.: 15/393,162

(22) Filed: Dec. 28, 2016

(51) Int. Cl.

| | |
|---|---|
| ***G08B 29/00*** | (2006.01) |
| ***G08B 29/02*** | (2006.01) |
| ***G08B 29/20*** | (2006.01) |
| ***G08B 25/00*** | (2006.01) |
| ***G08B 25/10*** | (2006.01) |

(52) U.S. Cl.
CPC ..... *G08B 29/02* (2013.01); *G08B 25/008* (2013.01); *G08B 25/10* (2013.01); *G08B 29/20* (2013.01)

(58) Field of Classification Search
CPC ..... H04W 4/008; A01K 11/006
USPC ..... 340/506
See application file for complete search history.

(56) References Cited

U.S. PATENT DOCUMENTS

| | | | | |
|---|---|---|---|---|
| 2004/0212500 | A1* | 10/2004 | Stilp | G08B 19/005 340/541 |
| 2013/0250354 | A1* | 9/2013 | Kato | H04N 1/00217 358/1.15 |
| 2014/0191848 | A1* | 7/2014 | Imes | H04B 5/0037 340/10.5 |
| 2016/0192040 | A1* | 6/2016 | Suresh | H04Q 9/00 340/870.07 |
| 2017/0245097 | A1* | 8/2017 | Chutorash | H04W 4/008 |

* cited by examiner

*Primary Examiner* — Fabricio R Murillo Garcia
(74) *Attorney, Agent, or Firm* — Schwegman Lundberg & Woessner, P.A.

(57) ABSTRACT

A system and method for configuring a security system using near-field communication devices that receive and transmit radio frequency signals is described. A first near-field communication device of the security system has a preset distance range. The security system communicates, using the first near-field communication device, with a second near-field communication device of a user device in response to the second near-field communication device being within the preset distance range of the first near-field communication device. The security system provides configuration information of the security system from the second near-field communication device to the first near-field communication device.

13 Claims, 5 Drawing Sheets

SYSTEM AND METHOD FOR CONFIGURING A SECURITY SYSTEM USING NEAR-FIELD COMMUNICATION

TECHNICAL FIELD

This application relates generally to a security system, and, in a specific example embodiment, to a system and method for configuring a security system using near-field communication devices that receive and transmit radio frequency signals.

BACKGROUND

Security systems commonly include a keypad on a control panel for controlling (e.g., arming or disarming), configuring (e.g., installing, "learning in" new sensors), and managing the security system. A display on the control panel displays visual information to a user of the security system in response to user input or system events and, in some cases, such display may include touch or proximity based input functions in addition to or in lieu of a keypad.

During a typical installation of new sensors, an installer reads identifying information (e.g., serial numbers) of the new sensors and enters it on the security system using the keypad and/or display. The duration of the installation process increases with the number of sensors and the placement of the sensors, since the installer has to walk back and forth between the control panel and the placement location of each new sensor.

BRIEF DESCRIPTION OF THE DRAWINGS

The present embodiments are illustrated by way of example, and not by way of limitation, in the figures of the accompanying drawings.

DETAILED DESCRIPTION

Figure 1:
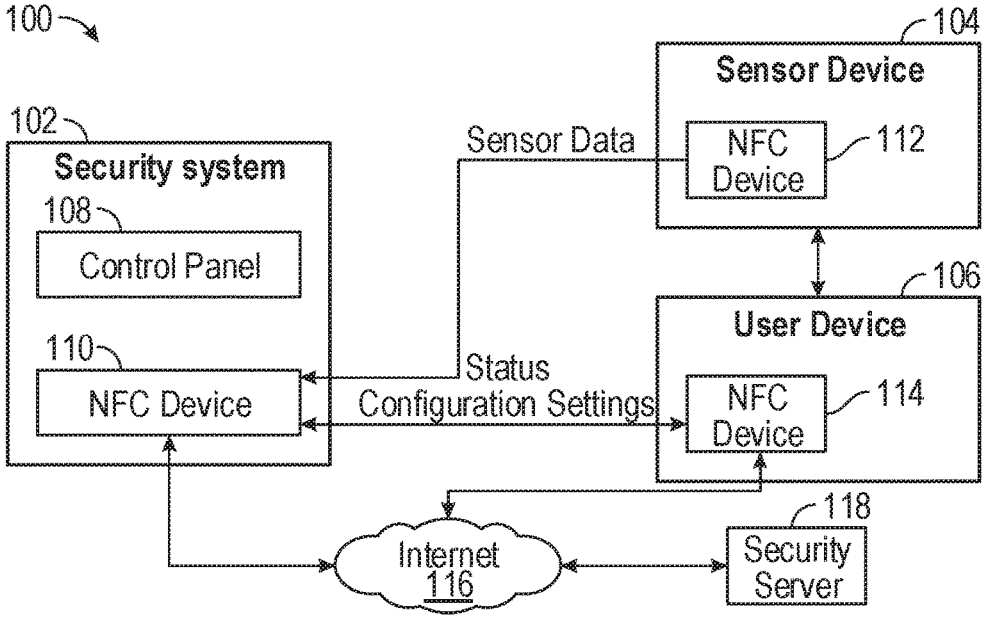
FIG. 1 is a block diagram illustrating one example embodiment of a security network.

Although the present disclosure has been described with reference to specific example embodiments, it will be evident that various modifications and changes may be made to these embodiments without departing from the broader spirit and scope of the disclosure. Accordingly, the specification and drawings are to be regarded in an illustrative rather than a restrictive sense.

The present disclosure describes viewing the status and configuration settings of a security system by using a near-field communication (NFC) device. For example, a status of an NFC-enabled security system can be retrieved without the need for a display on a control panel of the security system. In another example, the NFC-enabled security system can be configured by way of the NFC device without a user having to use a keypad on the control panel of the security system. With the inclusion of an NFC device in the control panel, a near-field secured link can be formed allowing a user to access the control panel for the purpose of configuration (e.g., adding new sensors to the security system, configuring locations of the sensors), determining status (e.g., whether all sensors are operational), and resetting the control panel. In one example embodiment, a visual indicator (e.g., an "error" or "attention" LED) on the control panel could light up to be used as an indication to the user that a near-field-secured link is active. The user would then use an NFC-enabled device (e.g., NFC-enabled smart phone) with appropriate software to read the error codes or other information off of the control panel, take appropriate action, and then upload new settings into the control panel.

Current control panels of security systems commonly use keypads, touchscreens, and/or remote terminals to configure the security system and display a status of the security system. In contrast, the presently described NFC-enabled security system allows for a fast and easy way for a display-less/keypad-less control panel to be configured or a detailed status report to be provided to the user. In one example embodiment, the NFC-enabled security system communicates with the end-user without the use of an expensive display, a central station, a computer network (e.g., TCP/IP connection), a backend data provider, or a cellular network. In another example, the NFC-enabled security system communicates with a central monitoring station (CMS), a computer network (e.g., TCP/IP connection), a backend data provider, or a cellular network. However, the amount of cellular data communication and interaction with the CMS is reduced since the status and configuration of the NFC-enabled security system can be accomplished through local NFC communication with the NFC-enabled device of the user.

In various embodiments, a system and method for configuring a security system using near-field communication devices that receive and transmit radio frequency signals are described. A first near-field communication device of the security system has a preset distance range. The security system communicates, using the first near-field communication device, with a second near-field communication device of a user device in response to the second near-field communication device being within the preset distance range of the first near-field communication device. The security system provides configuration information of the security system from the first near-field communication device to the second near-field communication device.

In one example embodiment, the security system receives updated configuration information from the second near-field communication device and updates configuration settings of the security system based on the updated configuration information.

In another example embodiment, the security system receives sensor configuration information of a sensor device from the second near-field communication device. The sensor configuration information includes, for example, a type of the sensor device, a serial number of the sensor device, and a location of the sensor device in a facility associated with the security system. The security system registers the sensor device with the security system, and updates configuration settings of the security system in response to registering the sensor device with the security system.

In another example embodiment, the configuration information includes a status of the security system, a status of sensor devices associated with the security system, sensor device registration information, and security system user registration information.

In another example embodiment, the security system communicates, using the first near-field communication device, with a third near-field communication device of a sensor device in response to the third near-field communication device being within the preset distance range of the first near-field communication device; receives sensor configuration information from the third near-field communication device at the first near-field communication device, and updates configuration settings of the security system based on the sensor configuration information.

In another example embodiment, the security system uses the sensor configuration information to associate the sensor device with the security system in a storage device of the security system. The sensor configuration information includes an identification of a type of the sensor device, a serial number of the sensor device, and a location of the sensor device in a facility associated with the security system.

In another example embodiment, the security system includes a visual indicator (e.g., LED) coupled to the first near-field communication device. The visual indicator is configured to generate a visual signal in response to an activation of the first near-field communication device.

In another example embodiment, the security system activates the first near-field communication device, receives updated configuration information from the second near-field communication device, updates configuration settings of the security system based on the updated configuration information, and deactivates the first near-field communication device after updating the configuration settings of the security system.

In another example embodiment, the security system includes a visual indicator that is coupled to the first near-field communication device. The visual indicator generates a visual signal in response to a malfunction of the security system. The security system detects the malfunction of the security system, activates the first near-field communication device in response to detecting the malfunction of the security system, receives updated configuration information from the second near-field communication device, updates configuration settings of the security system based on the updated configuration information, and deactivates the first near-field communication device after updating the configuration settings of the security system.

In another example embodiment, the security system includes a radio-frequency identification (RFID) reader (instead of the NFC device) having an RFID preset distance range. The security system receives, using the RFID reader, updated configuration information from an RFID tag of a sensor device in response to the RFID tag being within the preset distance range of the RFID reader, and updates configuration settings of the security system based on the configuration information of the security system.

FIG. 1 is a block diagram illustrating one example embodiment of a security network 100. The security network 100 includes a security system 102, a sensor device 104, a user device 106, a computer network (e.g., the Internet 116), and a security server 118. The security system 102 may be a security apparatus that enables users to protect himself or herself and his or her property. The security system 102 communicates with a plurality of sensor devices (e.g., sensor device 104) such as motion sensors or entry sensors, among others, which are installed in a residence or a commercial facility. The security system 102 communicates with the sensor devices (e.g., via radio transmission) to determine whether, for example, motion has been sensed in an area covered by a motion sensor. In some cases, the security system 102 then notifies a backend system (e.g., security server 118) of a breach of sensor devices via the Internet 116 or other wired or wireless communication means.

The user device 106 includes, for example, a mobile computing device such as a smart phone or tablet, among other example devices. The user device 106 is equipped with an NFC device 114 that enables the user device 106 to communicate with the security system 102 when the user device 106 is located within a preset distance range of the security system 102.

In one example embodiment, the sensor device 104 includes an NFC device 112 that enables the sensor device 104 to communicate with an NFC device 110 of the security system 102 when the sensor device 104 is in the proximity or within a preset distance range of the security system 102. Similarly, the NFC device 112 of the sensor device 104 enables the sensor device 104 to communicate with the NFC device 114 of the user device 106 when the sensor device 104 is within the preset distance range of the user device 106. In another example, the sensor device 104 can communicate its status via radio transmission with the security system 102.

In one example embodiment, the sensor device 104 is placed within a range of the NFC device 110 of the security system 102 to register the sensor device 104. The sensor device 104 may communicate registration information such as sensor type, serial number, and other pertinent information related to the sensor device 104 via the NFC devices 110, 112. In another example, the NFC device 112 can be used to pass an encryption key (in addition or instead of the serial number) to or from the new security sensor.

In another example embodiment, the user device 106 is placed within a range of the NFC device 112 of the sensor device 104 (which is, for example, affixed to a window in a room). The sensor device 104 may communicate to the user device 106 registration information such as sensor type, serial number, and other pertinent information related to the sensor device 104 via the NFC devices 112, 114. The user device 106 may be used to register the sensor device 104 with the security system 102 using, for example, a security system application stored on the user device 106. The security system application may be associated with the security system 102 via credential/authentication means (e.g., username and password).

In another example embodiment, the user device 106 is placed within a range of the NFC device 110 of the security system 102. The user device 106 can be used to retrieve and access status information from the security system 102. In addition, the user device 106 can be used to configure the security system 102 by communicating configuration information settings from the security system application on the user device 106 to the security system 102 via the NFC devices 110, 114.

The security system 102 can include a control panel 108 that enables a user or homeowner to arm or disarm the security system 102 by entering a personal identification code or passcode on a keypad of the control panel 108. An example of the control panel 108 is further illustrated with respect to FIG. 2.

Figure 2:
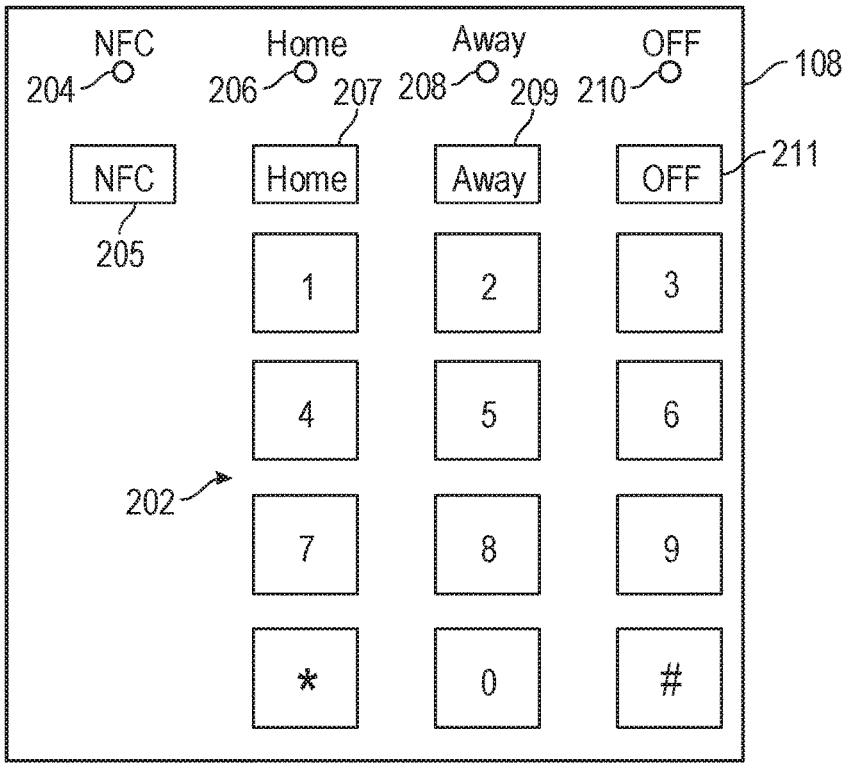
FIG. 2 is a diagram illustrating an example embodiment of a keypad of a control panel.

FIG. 2 is a diagram illustrating an example embodiment of a keypad of a control panel 108. The control panel 108 includes, for example, a keypad 202 and visual indicators 204, 206, 208, and 210. The keypad 202 allows a user to enter his or her passcode. Additional buttons such as an NFC button 205, a home button 207, an away button 209, and an off button 211 can be included. Pressing on the NFC button 205 activates the NFC device 110 for a limited period of time. Pressing on the home button 207 arms the security system 102 in a home mode that deactivates motion sensors but still detect entry sensors. Pressing on the away button 209 arms the security system 102 in an away mode that activates both motion sensors and entry sensors. Pressing on the off button 211 disarms the security system 102.

In another example embodiment, the NFC indicator 204 may be used to indicate an "error" status and to prompt the user to access status information by presenting the user device 106 within the preset range of the NFC device 110 of the security system 102.

Figure 3A:
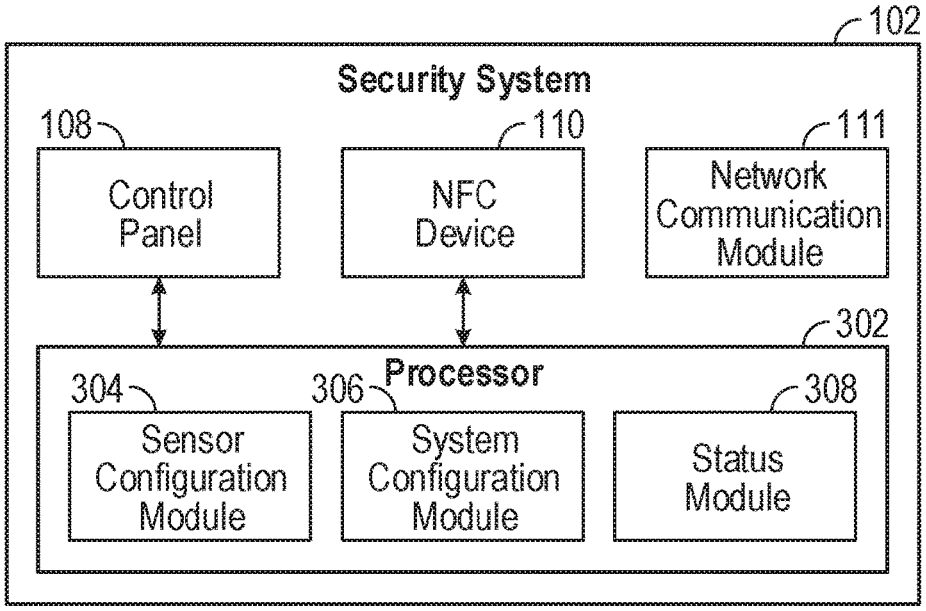
FIG. 3A is a block diagram illustrating an example embodiment of a security system.

FIG. 3A is a block diagram illustrating an example embodiment of a security system 102. The security system 102 includes the control panel 108, the NFC device 110, a network communication module 111, and a processor 302. The network communication module 111 includes a computer network interface that enables the security system 102 to access the Internet 116 or a local computer network. The processor 302 includes a sensor configuration module 304, a system configuration module 306, and a status module 308.

The sensor configuration module 304 registers sensor information from the sensor device 104. For example, the sensor configuration module 304 associates a unique name of the sensor device 104 with a type (e.g., motion, contact switch, temperature, smoke) of the sensor device 104, a serial number of the sensor device 104, and other uniquely identifiable information of the sensor device 104, a location (e.g., family room) of the sensor device 104 at a facility, and radio frequency identification with the security system 102. The learning process or registration process can be performed by presenting the sensor device 104 within the preset range of the NFC device 110 of the security system 102, by presenting the user device 106 within the preset range of the NFC device 112 of the sensor device 104, or a combination thereof.

The system configuration module 306 generates the configuration settings of the security system 102. For example, the configuration settings direct the security system 102 to arm automatically at a certain time, or to perform a particular function (e.g., sound the alarm, contact the homeowner) in response to a condition being satisfied (e.g., if a window cracks open at night time only). In one example, the configuration settings may be entered and generated on the security system application on the user device 106. The user device 106 is then presented to the NFC device 110 to program the security system 102 based on the configuration settings. In another example, the security server 118 provides the configuration settings to the security system 102 via the Internet 116.

The status module 308 determines the status of the sensor device 104 (e.g., open, closed, motion, no motion). In one example, the status module 308 receives periodic updates from the sensor device 104 via radio transmission or other wireless or wired means. The status module 308 communicates the status of the sensor device 104 to the user device 106 via the NFC devices 110, 114. In another example, the status of the sensor device 104 shows that its battery is running low. The error LED 204 illuminates to prompt the user to present the user device 106 to the security system 102 to determine the source of the error. The status module 308 communicates to the user device 106 that the battery on the sensor device 104 is running low. Once the status module 308 communicates the status to the user device 106, the error LED 204 is no longer illuminated.

Figure 3B:
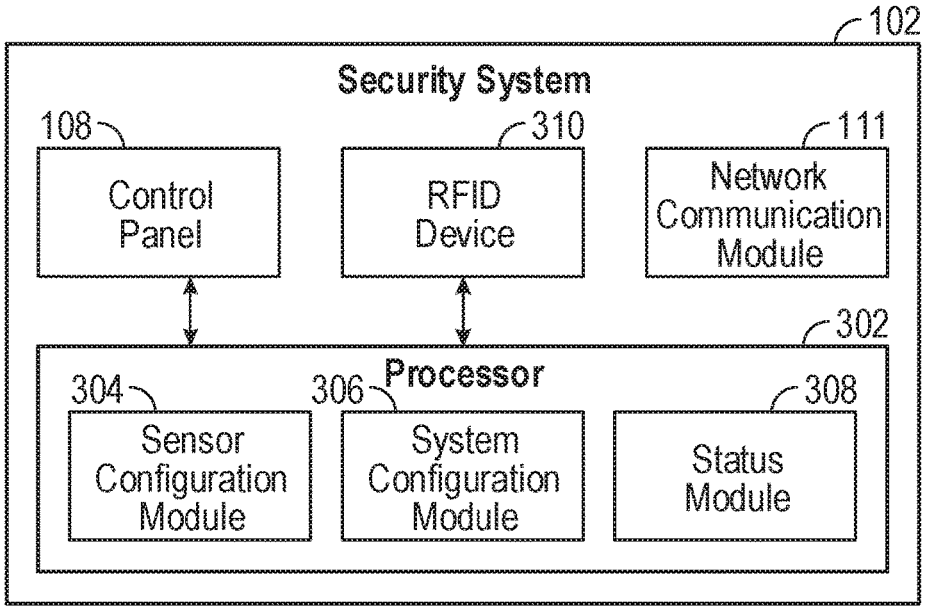
FIG. 3B is a block diagram illustrating another example embodiment of a security system.

FIG. 3B is a block diagram illustrating another example embodiment of a security system 102. The security system 102 includes the control panel 108, an RFID device 310 (e.g., RFID reader), the network communication module 111, and the processor 302. The network communication module 111 includes a computer network interface that enables the security system 102 to access the Internet 116 or a local computer network. The processor 302 includes a sensor configuration module 304, a system configuration module 306, and a status module 308.

The sensor configuration module 304 registers sensor information from the sensor device 104. For example, the sensor configuration module 304 associates a unique name of the sensor device 104 with a type (e.g., motion, contact switch, temperature, smoke) of the sensor device 104, a serial number of the sensor device 104, and other uniquely identifiable information of the sensor device 104, a location (e.g., family room) of the sensor device 104, and a radio frequency identification with the security system 102. The learning process or registration process can be performed by presenting the sensor device 104 within the preset range of the RFID device 310 of the security system 102, by presenting the user device 106 within the preset range of an RFID tag of the sensor device 104, or a combination thereof.

The system configuration module 306 generates the configuration settings of the security system 102. For example, the configuration settings direct the security system 102 to arm automatically at a certain time, or to perform a particular function (e.g., sound the alarm, contact the homeowner) in response to a condition being satisfied (e.g., if a window cracks open at night time only). In one example, the configuration settings may be entered and generated on the security system application on the user device 106. The user device 106 is then presented to the RFID device 310 to program the security system 102 based on the configuration settings. In another example, the security server 118 provides the configuration settings to the security system 102 via the Internet 116.

The status module 308 determines the status of the sensor device 104 (e.g., open, closed, motion, no motion). In one example, the status module 308 receives periodic updates from the sensor device 104 via radio transmission or other wireless or wired means. The status module 308 communicates the status of the sensor device 104 to the user device 106 via the RFID device 310 and another RFID device in the user device 106. In another example, the status of the sensor device 104 shows that its battery is running low. The error LED 204 illuminates to prompt the user to present the user device 106 to the security system 102 to determine the source of the error. The status module 308 communicates to the user device 106 that the battery on the sensor device 104 is running low. Once the status module 308 communicates the status to the user device 106, the error LED 204 is no longer illuminated.

Figure 4:
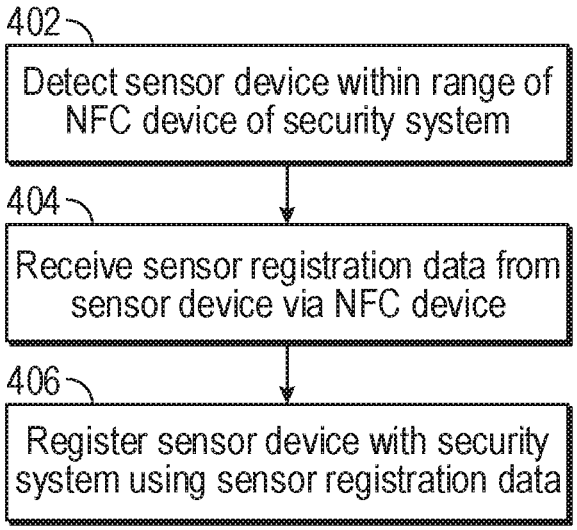
FIG. 4 is a flow diagram illustrating an example embodiment of a method for registering new sensor devices with a security system.

FIG. 4 is a flow diagram illustrating an example embodiment of a method for registering new sensor devices with a security system. At operation 402, the security system detects a sensor device when the sensor device is within a preset range of the NFC device of the security system. At operation 404, the security system receives sensor registration information from the sensor device via the NFC devices. At operation 406, the security system registers the sensor device using the sensor registration information.

Figure 5:
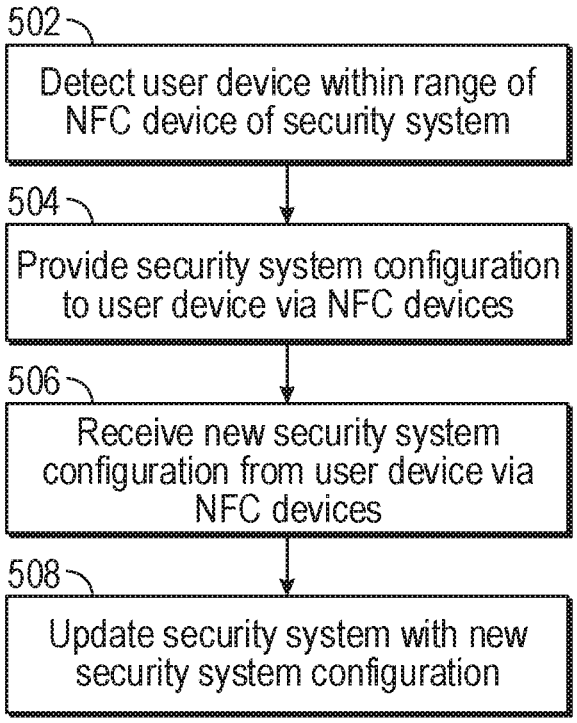
FIG. 5 is a flow diagram illustrating an example embodiment of a method for updating a security system configuration.

FIG. 5 is a flow diagram illustrating an example embodiment of a method for updating a security system configuration. At operation 502, the security system detects that a user device is within a preset range of the NFC device of the security system. At operation 504, the security system provides a security system configuration to the user device via the NFC devices. At operation 506, the security system receives an updated or new security system configuration from the user device via the NFC devices. At operation 508, the security system is updated with the new security system configuration.

Figure 6:
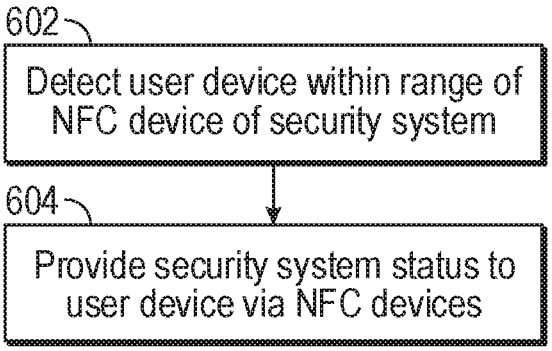
FIG. 6 is a flow diagram illustrating an example embodiment of a method for providing a status of a security system to a user device.

FIG. 6 is a flow diagram illustrating an example embodiment of a method for providing a status of a security system to a user device. At operation 602, the security system detects that the user device is within a preset range of the NFC device of the security system. At operation 604, the security system provides a security system status to the user device via the NFC devices.

Figure 7:
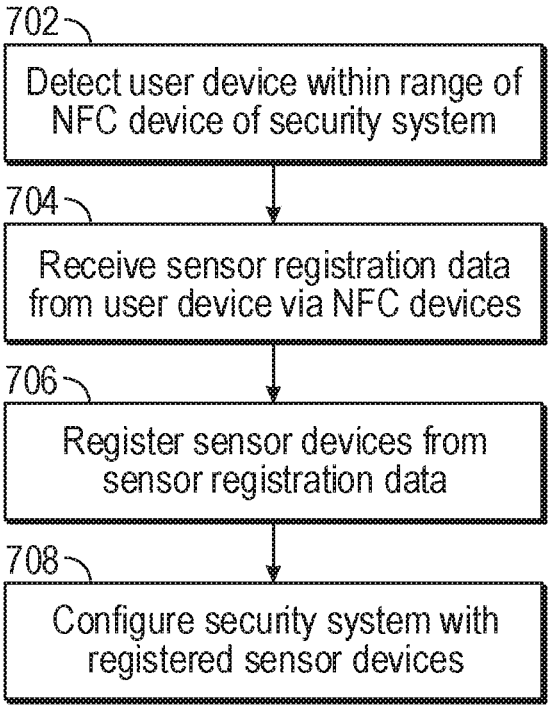
FIG. 7 is a flow diagram illustrating an example embodiment of a method for configuring a security system with new sensor devices registered with a user device.

FIG. 7 is a flow diagram illustrating an example embodiment of a method for configuring a security system with new sensor devices registered with a user device. At operation 702, the security system detects that the user device is within the preset range of the NFC device of the security system. At operation 704, the security system receives sensor registration data from the user device via the NFC devices. At operation 706, the security system registers the new sensor devices using the sensor registration data. At operation 708, the security system is configured to operate with the new sensor devices based on the sensor registration data.

Modules, Components, and Logic

Certain embodiments are described herein as including logic or a number of components, modules, or mechanisms. Modules may constitute either software modules (e.g., code embodied on a machine-readable medium or in a transmission signal) or hardware modules. A hardware module is a tangible unit capable of performing certain operations and may be configured or arranged in a certain manner. In example embodiments, one or more computer systems (e.g., a standalone, client, or server computer system) or one or more hardware modules of a computer system (e.g., a processor or a group of processors) may be configured by software (e.g., an application or application portion) as a hardware module that operates to perform certain operations as described herein.

In various embodiments, a hardware module may be implemented mechanically or electronically. For example, a hardware module may comprise dedicated circuitry or logic that is permanently configured (e.g., as a special-purpose processor, such as a field programmable gate array (FPGA) or an application-specific integrated circuit (ASIC)) to perform certain operations. A hardware module may also comprise programmable logic or circuitry (e.g., as encompassed within a general-purpose processor or other programmable processor) that is temporarily configured by software to perform certain operations. It will be appreciated that the decision to implement a hardware module mechanically, in dedicated and permanently configured circuitry, or in temporarily configured circuitry (e.g., configured by software) may be driven by cost and time considerations.

Accordingly, the term "hardware module" should be understood to encompass a tangible entity, be that an entity that is physically constructed, permanently configured (e.g., hardwired), or temporarily configured (e.g., programmed) to operate in a certain manner and/or to perform certain operations described herein. Considering embodiments in which hardware modules are temporarily configured (e.g., programmed), each of the hardware modules need not be configured or instantiated at any one instance in time. For example, where the hardware modules comprise a general-purpose processor configured using software, the general-purpose processor may be configured as respective different hardware modules at different times. Software may accordingly configure a processor, for example, to constitute a particular hardware module at one instance of time and to constitute a different hardware module at a different instance of time.

Hardware modules can provide information to, and receive information from, other hardware modules. Accordingly, the described hardware modules may be regarded as being communicatively coupled. Where multiple of such hardware modules exist contemporaneously, communications may be achieved through signal transmission (e.g., over appropriate circuits and buses that connect the hardware modules). In embodiments in which multiple hardware modules are configured or instantiated at different times, communications between or among such hardware modules may be achieved, for example, through the storage and retrieval of information in memory structures to which the multiple hardware modules have access. For example, one hardware module may perform an operation and store the output of that operation in a memory device to which it is communicatively coupled. A further hardware module may then, at a later time, access the memory device to retrieve and process the stored output. Hardware modules may also initiate communications with input or output devices and can operate on a resource (e.g., a collection of information).

The various operations of example methods described herein may be performed, at least partially, by one or more processors that are temporarily configured (e.g., by software) or permanently configured to perform the relevant operations. Whether temporarily or permanently configured, such processors may constitute processor-implemented modules that operate to perform one or more operations or functions. The modules referred to herein may, in some example embodiments, comprise processor-implemented modules.

Similarly, the methods described herein may be at least partially processor-implemented. For example, at least some of the operations of a method may be performed by one or more processors or processor-implemented modules. The performance of certain of the operations may be distributed among the one or more processors, not only residing within a single machine, but deployed across a number of machines. In some example embodiments, the processor or processors may be located in a single location (e.g., within a home environment, an office environment, or a server farm), while in other embodiments the processors may be distributed across a number of locations.

The one or more processors may also operate to support performance of the relevant operations in a "cloud computing" environment or as a "software as a service" (SaaS). For example, at least some of the operations may be performed by a group of computers (as examples of machines including processors), these operations being accessible via a communication network and via one or more appropriate interfaces (e.g., application programming interfaces (APIs)).

Electronic Apparatus and System

Example embodiments may be implemented in digital electronic circuitry, in computer hardware, firmware, or software, or in combinations of them. Example embodiments may be implemented using a computer program product, e.g., a computer program tangibly embodied in an information carrier, e.g., in a machine-readable medium for execution by, or to control the operation of, data processing apparatus, e.g., a programmable processor, a computer, or multiple computers.

A computer program can be written in any form of programming language, including compiled or interpreted languages, and it can be deployed in any form, including as a standalone program or as a module, subroutine, or other unit suitable for use in a computing environment. A computer program can be deployed to be executed on one computer or on multiple computers at one site or distributed across multiple sites and interconnected by a communication network.

In example embodiments, operations may be performed by one or more programmable processors executing a computer program to perform functions by operating on input data and generating output. Method operations can also be performed by, and apparatus of example embodiments may be implemented as, special-purpose logic circuitry (e.g., an FPGA or an ASIC).

A computing system can include clients and servers. A client and server are generally remote from each other and typically interact through a communication network. The relationship of client and server arises by virtue of computer programs running on the respective computers and having a client-server relationship to each other. In embodiments deploying a programmable computing system, it will be appreciated that both hardware and software architectures merit consideration. Specifically, it will be appreciated that the choice of whether to implement certain functionality in permanently configured hardware (e.g., an ASIC), in temporarily configured hardware (e.g., a combination of software and a programmable processor), or in a combination of permanently and temporarily configured hardware may be a design choice. Below are set out hardware (e.g., machine) and software architectures that may be deployed, in various example embodiments.

Example Machine Architecture

Figure 8:
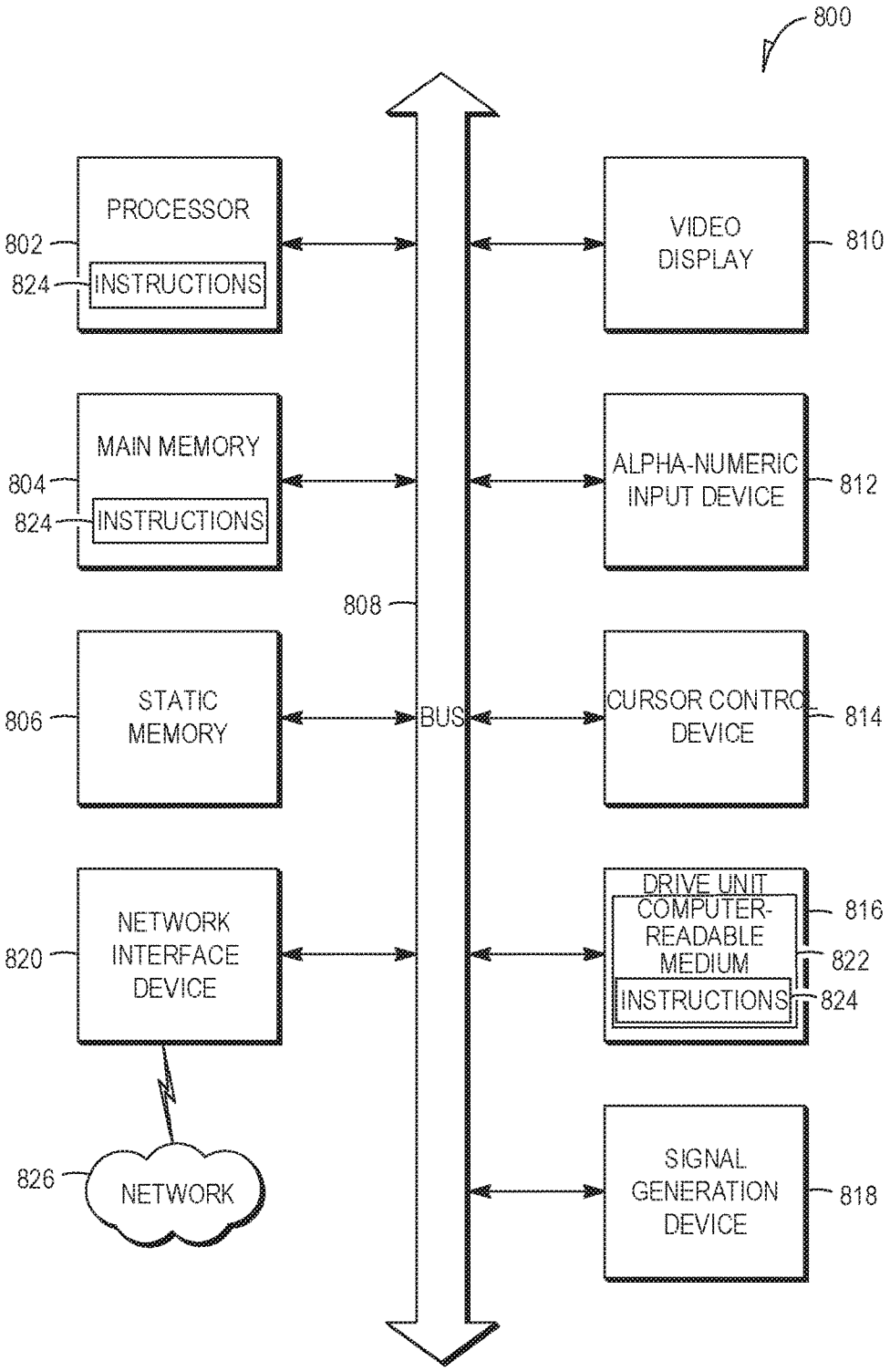
FIG. 8 shows a diagrammatic representation of a machine in the example form of a computer system within which a set of instructions may be executed to cause the machine to perform any one or more of the methodologies discussed herein.

FIG. 8 is a block diagram of a machine in the example form of a computer system 800 within which instructions 824 for causing the machine to perform any one or more of the methodologies discussed herein may be executed. In alternative embodiments, the machine operates as a standalone device or may be connected (e.g., networked) to other machines. In a networked deployment, the machine may operate in the capacity of a server or a client machine in a server-client network environment, or as a peer machine in a peer-to-peer (or distributed) network environment. The machine may be a personal computer (PC), a tablet PC, a set-top box (STB), a personal digital assistant (PDA), a cellular telephone, a web appliance, a network router, a network switch, a network bridge, or any machine capable of executing the instructions 824 (sequential or otherwise) that specify actions to be taken by that machine. Further, while only a single machine is illustrated, the term "machine" shall also be taken to include any collection of machines that individually or jointly execute a set (or multiple sets) of instructions 824 to perform any one or more of the methodologies discussed herein.

The example computer system 800 includes a processor 802 (e.g., a central processing unit (CPU), a graphics processing unit (GPU), or both), a main memory 804, and a static memory 806, which communicate with each other via a bus 808. The computer system 800 may further include a video display unit 810 (e.g., a liquid crystal display (LCD) or a cathode ray tube (CRT)). The computer system 800 also includes an alphanumeric input device 812 (e.g., a keyboard), a user interface (UI) navigation (or cursor control) device 814 (e.g., a mouse), a disk drive unit 816, a signal generation device 818 (e.g., a speaker), and a network interface device 820.

Machine-Readable Medium

The disk drive unit 816 includes a computer- (or machine-) readable medium 822 on which is stored one or more sets of data structures and instructions 824 (e.g., software) embodying or utilized by any one or more of the methodologies or functions described herein. The instructions 824 may also reside, completely or at least partially, within the main memory 804 and/or within the processor 802 during execution thereof by the computer system 800, the main memory 804 and the processor 802 also constituting computer-readable media 822. The instructions 824 may also reside, completely or at least partially, within the static memory 806.

While the computer-readable medium 822 is shown, in an example embodiment, to be a single medium, the term "machine-readable medium" may include a single medium or multiple media (e.g., a centralized or distributed database, and/or associated caches and servers) that store the one or more instructions 824 or data structures. The term "computer-readable medium" shall also be taken to include any tangible medium that is capable of storing, encoding, or carrying the instructions 824 for execution by the machine and that cause the machine to perform any one or more of the methodologies of the present embodiments, or that is capable of storing, encoding, or carrying data structures utilized by or associated with such instructions 824. The term "computer-readable medium" shall accordingly be taken to include, but not be limited to, solid-state memories, and optical and magnetic media. Specific examples of computer-readable media 822 include non-volatile memory, including by way of example semiconductor memory devices (e.g., erasable programmable read-only memory (EPROM), electrically erasable programmable read-only memory (EEPROM), and flash memory devices); magnetic disks such as internal hard disks and removable disks; magneto-optical disks; and compact disc-read-only memory (CD-ROM) and digital versatile disc (or digital video disc) read-only memory (DVD-ROM) disks.

Transmission Medium

The instructions 824 may further be transmitted or received over a communication network 826 using a transmission medium. The instructions 824 may be transmitted using the network interface device 820 and any one of a number of well-known transfer protocols (e.g., hypertext transfer protocol (HTTP)). Examples of communication networks 826 include a local-area network (LAN), a wide-area network (WAN), the Internet, mobile telephone networks, plain old telephone service (POTS) networks, and wireless data networks (e.g., Wi-Fi and WiMAX networks). The term "transmission medium" shall be taken to include any intangible medium capable of storing, encoding, or carrying the instructions 824 for execution by the machine, and includes digital or analog communications signals or other intangible media to facilitate communication of such software.

Although an embodiment has been described with reference to specific example embodiments, it will be evident that various modifications and changes may be made to these embodiments without departing from the scope of the present disclosure. Accordingly, the specification and drawings are to be regarded in an illustrative rather than a restrictive sense. The accompanying drawings that form a part hereof show by way of illustration, and not of limitation, specific embodiments in which the subject matter may be practiced. The embodiments illustrated are described in sufficient detail to enable those skilled in the art to practice the teachings disclosed herein. Other embodiments may be utilized and derived therefrom, such that structural and logical substitutions and changes may be made without departing from the scope of this disclosure. This Detailed Description, therefore, is not to be taken in a limiting sense, and the scope of various embodiments is defined only by the appended claims, along with the full range of equivalents to which such claims are entitled.

Such embodiments of the inventive subject matter may be referred to herein, individually and/or collectively, by the term "invention" merely for convenience and without intending to voluntarily limit the scope of this application to any single invention or inventive concept if more than one is in fact disclosed. Thus, although specific embodiments have been illustrated and described herein, it should be appreciated that any arrangement calculated to achieve the same purpose may be substituted for the specific embodiments shown. This disclosure is intended to cover any and all adaptations or variations of various embodiments. Combinations of the above embodiments, and other embodiments not specifically described herein, will be apparent to those of skill in the art upon reviewing the above description.

The Abstract of the Disclosure is provided to allow the reader to quickly ascertain the nature of the technical disclosure. It is submitted with the understanding that it will not be used to interpret or limit the scope or meaning of the claims. In addition, in the foregoing Detailed Description, it can be seen that various features are grouped together in a single embodiment for the purpose of streamlining the disclosure. This method of disclosure is not to be interpreted as reflecting an intention that the claimed embodiments require more features than are expressly recited in each claim. Rather, as the following claims reflect, inventive subject matter lies in less than all features of a single disclosed embodiment. Thus, the following claims are hereby incorporated into the Detailed Description, with each claim standing on its own as a separate embodiment.

The following enumerated embodiments describe various example embodiments of a security system discussed herein.

A first embodiment provides a security system 102 comprising:

a first near-field communication device 110 having a preset distance range; and a processor 302 configured to perform operations comprising:

communicating, using the first near-field communication device 110, with a second near-field communication device 114 of a user device 106 in response to the second near-field communication device 114 being within the preset distance range of the first near-field communication device 110; and providing configuration information of the security system 102 from the first near-field communication device 114 to the second near-field communication device 110.

A second embodiment provides a security system according to the first embodiment, wherein the operations further comprise:

receiving updated configuration information from the second near-field communication device; and updating configuration settings of the security system based on the updated configuration information.

A third embodiment provides a security system according to the first embodiment, wherein the operations further comprise:

receiving sensor configuration information of a sensor device from the second near-field communication device, the sensor configuration information including a type of the sensor device, a serial number of the sensor device, and a location of the sensor device in a facility associated with the security system;

registering the sensor device with the security system; and updating configuration settings of the security system in response to registering the sensor device with the security system.

A fourth embodiment provides a security system according to the first embodiment, wherein the configuration information includes a status of the security system, a status of sensor devices associated with the security system, sensor device registration information, and security system user registration information.

A fifth embodiment provides a security system according to the first embodiment, wherein the operations further comprise:

communicating, using the first near-field communication device, with a third near-field communication device of a sensor device in response to the third near-field communication device being within the preset distance range of the first near-field communication device;

receiving sensor configuration information from the third near-field communication device at the first near-field communication device; and updating configuration settings of the security system based on the sensor configuration information.

A sixth embodiment provides a security system according to the fifth embodiment, wherein the operations further comprise:

using the sensor configuration information to associate the sensor device with the security system in a storage device of the security system, wherein the sensor configuration information includes an identification of a type of the sensor device, a serial number of the sensor device, and a location of the sensor device in a facility associated with the security system.

A seventh embodiment provides a security system according to the first embodiment, further comprising:

a visual indicator coupled to the first near-field communication device, the visual indicator configured to generate a visual signal in response to an activation of the first near-field communication device.

An eight embodiment provides a security system according to the seventh embodiment, wherein the operations further comprise:

activating the first near-field communication device;

receiving updated configuration information from the second near-field communication device;

updating configuration settings of the security system based on the updated configuration information; and deactivating the first near-field communication device after updating the configuration settings of the security system.

A ninth embodiment provides a security system according to the first embodiment, further comprising:

a visual indicator coupled to the first near-field communication device, the visual indicator configured to generate a visual signal in response to a malfunction of the security system, wherein the operations further comprise:

detecting the malfunction of the security system;

activating the first near-field communication device in response to detecting the malfunction of the security system;

receiving updated configuration information from the second near-field communication device;

updating configuration settings of the security system based on the updated configuration information; and deactivating the first near-field communication device after updating the configuration settings of the security system.

A tenth embodiment provides a security system according to the first embodiment, further comprising:

a radio-frequency identification (RFID) reader having an RFID preset distance range, wherein the operations further comprise:

receiving, using the RFID reader, updated configuration information from an RFID tag of a sensor device in response to the RFID tag being within the RFID preset distance range of the RFID reader; and updating configuration settings of the security system based on the updated configuration information of the security system.

What is claimed is:

1. A security system comprising:

a first near-field communication device having a preset distance range, the first near-field communication device configured to detect and communicate with a second near-field communication device of a user device being present within the preset distance range; and a security control panel coupled to the first near-field communication device, the security control panel configured to:

arm and disarm the security system, provide sensor status information and configuration information of the security control panel to the second near-field communication device of the user device using the first near-field communication device, the sensor status information indicating an operational status for each sensor device of a plurality of sensor devices registered with the security control panel, a visual indicator coupled to the first near-field communication device, the visual indicator configured to generate a visual signal in response to a malfunction of the security system, wherein the security control panel is further configured to:

detect the malfunction of the security system, identify a malfunctioning sensor device from the plurality of sensor devices, the malfunctioning sensor device associated with the malfunction, activate the first near-field communication device in response to detecting the malfunction of the security system, provide an identification of the malfunctioning sensor device to the second near-field communication device via the first near-field communication device, receive updated configuration information from the second near-field communication device in response to providing the identification of the malfunctioning sensor device, update configuration settings of the security system based on the updated configuration information, and deactivate the first near-field communication device after updating the configuration settings of the security system.

2. The security system of claim 1, wherein the security control panel is configured to receive sensor configuration information of a sensor device of the plurality of sensor devices from the second near-field communication device, the sensor configuration information including a type of the sensor device, a serial number of the sensor device, and a location of the sensor device in a facility associated with the security system, wherein the security control panel is further configured to register the sensor device with the security system, and to update configuration settings of the security system in response to registering the sensor device with the security system.

3. The security system of claim 1, wherein the configuration information includes a status of the security system, a status of sensor devices associated with the security system, sensor device registration information, and security system user registration information.

4. The security system of claim 1, wherein the security control panel is configured to communicate, using the first near-field communication device, with a third near-field communication device of a sensor device of the plurality of sensor devices in response to the third near-field communication device being within the preset distance range of the first near-field communication device, to receive sensor configuration information from the third near-field communication device at the first near-field communication device, and to update configuration settings of the security system based on the sensor configuration information from the third near-field communication device.

5. The security system of claim 4, wherein the sensor configuration information is used to associate the sensor device with the security system in a storage device of the security system, wherein the sensor configuration information includes an identification of a type of the sensor device, a serial number of the sensor device, and a location of the sensor device in a facility associated with the security system.

6. The security system of claim 1, further comprising:

a radio-frequency identification (RFID) reader having an RFID preset distance range, wherein the security control panel is configured to receive, using the RFID reader, updated configuration information from an RFID tag of a sensor device in response to the RFID tag being within the RFID preset distance range of the RFID reader; and to update configuration settings of the security system based on the updated configuration information of the security system.

7. A method comprising:

detecting that a second near-filed communication device of a user device is within a preset range of a first near-field communication device of a security system, the security system comprising a security control panel configured to arm and disarm the security system;

communicating, using the first near-field communication device of the security system, with the second near-field communication device of the user device in response to the second near-field communication device being within a preset distance range of the first near-field communication device; and providing sensor status information and configuration information of the security control panel from the first near-field communication device to the second first near-field communication device of the user device, the sensor status information indicating an operational status for each sensor device of a plurality of sensor devices registered with the security control panel;

generating a visual signal in response to a malfunction of the security system with a visual indicator coupled to the first near-field communication device;

detecting the malfunction of the security system;

identifying a malfunctioning sensor device from the plurality of sensor devices, the malfunctioning sensor device associated with the malfunction;

activating the first near-field communication device in response to detecting the malfunction of the security system;

providing an identification of the malfunctioning sensor device to the second near-field communication device via the first near-field communication device;

receiving updated configuration information from the second near-field communication device in response to providing the identification of the malfunctioning sensor device;

updating configuration settings of the security system based on the updated configuration information; and deactivating the first near-field communication device after updating the configuration settings of the security system.

8. The method of claim 7, further comprising:

receiving sensor configuration information of a sensor device of the plurality of sensor devices from the second near-field communication device, the sensor configuration information including a type of the sensor device, a serial number of the sensor device, and a location of the sensor device in a facility associated with the security system;

registering the sensor device with the security system; and updating configuration settings of the security system in response to registering the sensor device with the security system.

9. The method of claim 7, wherein the configuration information includes a status of the security system, a status of sensor devices associated with the security system, sensor device registration information, and security system user registration information.

10. The method of claim 7, further comprising:

communicating, using the first near-field communication device, with a third near-field communication device of a sensor device of the plurality of sensor devices in response to the third near-field communication device being within the preset distance range of the first near-field communication device;

receiving sensor configuration information from the third near-field communication device at the first near-field communication device; and updating configuration settings of the security system based on the sensor configuration information from the third near-field communication device.

11. The method of claim 10, further comprising:

using the sensor configuration information to associate the sensor device with the security system in a storage device of the security system, wherein the sensor configuration information includes an identification of a type of the sensor device, a serial number of the sensor device, and a location of the sensor device in a facility associated with the security system.

12. The method of claim 7, further comprising:

receiving, using a radio-frequency identification (RFID) reader of the security system, updated configuration information from an RFID tag of a sensor device in response to the RFID tag of the sensor device being within a preset distance range of the RFID reader; and updating configuration settings of the security system based on the updated configuration information of the security system.

13. A non-transitory computer-readable storage medium storing a set of instructions that, when executed by a processor, cause the processor to perform operations comprising:

detecting that a second near-filed communication device of a user device is within a preset range of a first near-field communication device of a security system, the security system comprising a security control panel configured to arm and disarm the security system;

communicating, using the first near-field communication device of the security system, with the second near-field communication device of the user device in response to the second near-field communication device being within a preset distance range of the first near-field communication device;

providing sensor status information and configuration information of the security control panel from the first near-field communication device to the second near-field communication device of the user device, the sensor status information indicating an operational status for each sensor device of a plurality of sensor devices registered with the security control panel;

generating a visual signal in response to a malfunction of the security system with a visual indicator coupled to the first near-field communication device;

detecting the malfunction of the security system;

identifying a malfunctioning sensor device from the plurality of sensor devices, the malfunctioning sensor device associated with the malfunction;

activating the first near-field communication device in response to detecting the malfunction of the security system;

providing an identification of the malfunctioning sensor device to the second near-field communication device via the first near-field communication device;

receiving updated configuration information from the second near-field communication device in response to providing the identification of the malfunctioning sensor device;

updating configuration settings of the security system based on the updated configuration information; and deactivating the first near-field communication device after updating the configuration settings of the security system.

* * * * *